US007907116B2

(12) United States Patent
Ng et al.

(10) Patent No.: US 7,907,116 B2
(45) Date of Patent: Mar. 15, 2011

(54) DUAL OUTPUT VOLTAGE SYSTEM WITH CHARGE RECYCLING

(75) Inventors: Wai Hon Ng, N.T. (HK); Man Chun Wong, N.T. (HK); Chi Wai Ng, Tsuen Wan (HK); Siu Kei Wong, N.T. (HK); Jimmy Chiu, Shatin (HK)

(73) Assignee: Solomon Systech Limited, Shatin, N.T. (HK)

( * ) Notice: Subject to any disclaimer, the term of this patent is extended or adjusted under 35 U.S.C. 154(b) by 966 days.

(21) Appl. No.: 11/797,389

(22) Filed: May 3, 2007

(65) Prior Publication Data

US 2008/0273007 A1 Nov. 6, 2008

(51) Int. Cl.
*G09G 3/34* (2006.01)

(52) U.S. Cl. ..... 345/107

(58) Field of Classification Search ..... 345/46, 345/83, 89, 94, 95, 98, 100, 107, 204, 211, 345/212, 213; 323/283, 284, 288; 324/76.11, 324/76.79, 536; 363/59; 327/536, 538, 165, 327/156, 157, 105, 147, 159; 315/291
See application file for complete search history.

(56) References Cited

U.S. PATENT DOCUMENTS 4,083,059 A * 4/1978 Tsunekawa et al. ..... 396/167
4,086,584 A * 4/1978 Kozuki et al. ..... 396/238
4,371,850 A * 2/1983 Klement ..... 341/143
4,464,609 A * 8/1984 Nakamura et al. ..... 315/241 P
4,659,994 A * 4/1987 Poljak ..... 324/426
4,947,157 A 8/1990 Di Santo et al.
5,548,250 A * 8/1996 Fang ..... 331/14
5,607,122 A * 3/1997 Hicks et al. ..... 244/17.19
5,861,861 A * 1/1999 Nolan et al. ..... 345/87
6,194,929 B1 * 2/2001 Drost et al. ..... 327/156
6,556,177 B1 4/2003 Katayama et al.
6,774,708 B2 * 8/2004 Matsui ..... 327/536
6,937,075 B2 * 8/2005 Lim et al. ..... 327/157
7,170,271 B2 * 1/2007 Coffey et al. ..... 323/284
7,605,579 B2 * 10/2009 Betser et al. ..... 324/76.11
7,663,619 B2 * 2/2010 Morita ..... 345/212
7,825,885 B2 * 11/2010 Sato et al. ..... 345/89
2002/0167343 A1 * 11/2002 Erhart et al. ..... 327/94
(Continued)

OTHER PUBLICATIONS

Muhlemann, "A 30-V Row / Column Driver for Flat-Panel Liquid Crystal Displays", IEEE Journal of Solid-State Circuits, vol. 23, No. 2, pp. 442-449, Apr. 1988. Crawford, "Flexible Flat Panel Display Technology", pp. 1-9, Wiley, 2005.
Amundson, "Electrophoretic Imaging Films for Electronic Paper Displays", pp. 369-391, Wiley 2005.

*Primary Examiner* — Prabodh M Dharia
(74) *Attorney, Agent, or Firm* — Finnegan, Henderson, Farabow, Garrett & Dunner, LLP

(57) ABSTRACT

A drive system for a display having segment and common lines is provided. The system may include a first charge pump; a first storage capacitor coupled to the first charge pump at a first pumped voltage level; a second charge pump, including an input terminal coupled to the first storage capacitor; and a second storage capacitor coupled to a pump output terminal at the second pumped voltage level. The system may also include a controller coupled to the first and second storage capacitors, coupled to segment and common lines of an associated display; and a control circuit operating a plurality of switching devices to selectively connect the segment output terminal to the first and second storage capacitors to supply charge to the segment output terminal during a first phase and to return charge from the segment output terminal to the second storage capacitor during a second phase.

8 Claims, 12 Drawing Sheets

U.S. PATENT DOCUMENTS

2003/0058029 A1* 3/2003 Matsui ..... 327/536
2004/0239386 A1* 12/2004 Lim et al. ..... 327/156
2005/0093792 A1* 5/2005 Yamamoto et al. ..... 345/83
2005/0248967 A1* 11/2005 Coffey et al. ..... 363/59
2006/0109205 A1* 5/2006 Deng ..... 345/46
2006/0109232 A1* 5/2006 Kuo ..... 345/100
2006/0158413 A1* 7/2006 Morita ..... 345/94
2008/0094127 A1* 4/2008 Betser et al. ..... 327/536
2008/0126059 A1* 5/2008 Harrison ..... 703/13

* cited by examiner

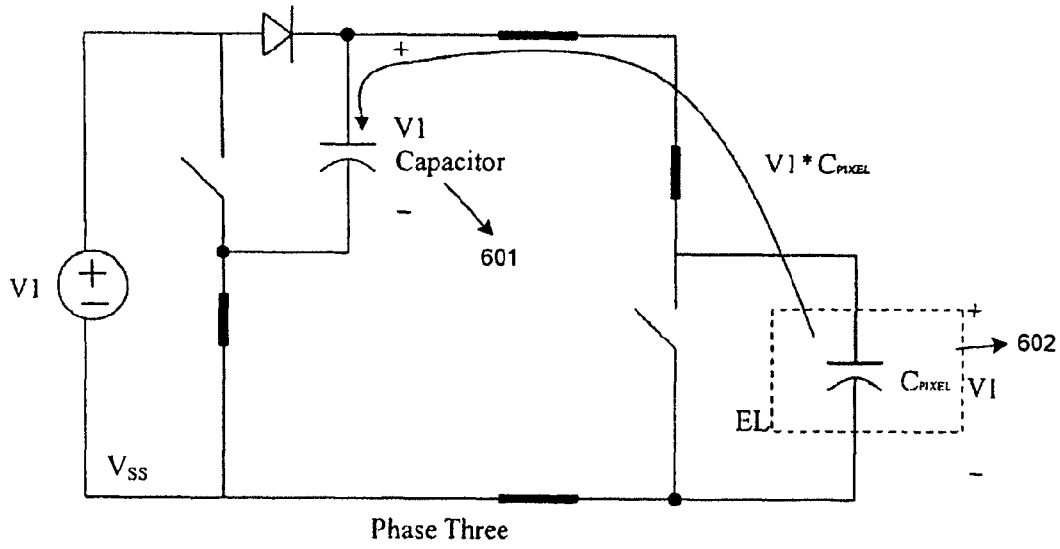
Figure 7C (Prior Art)
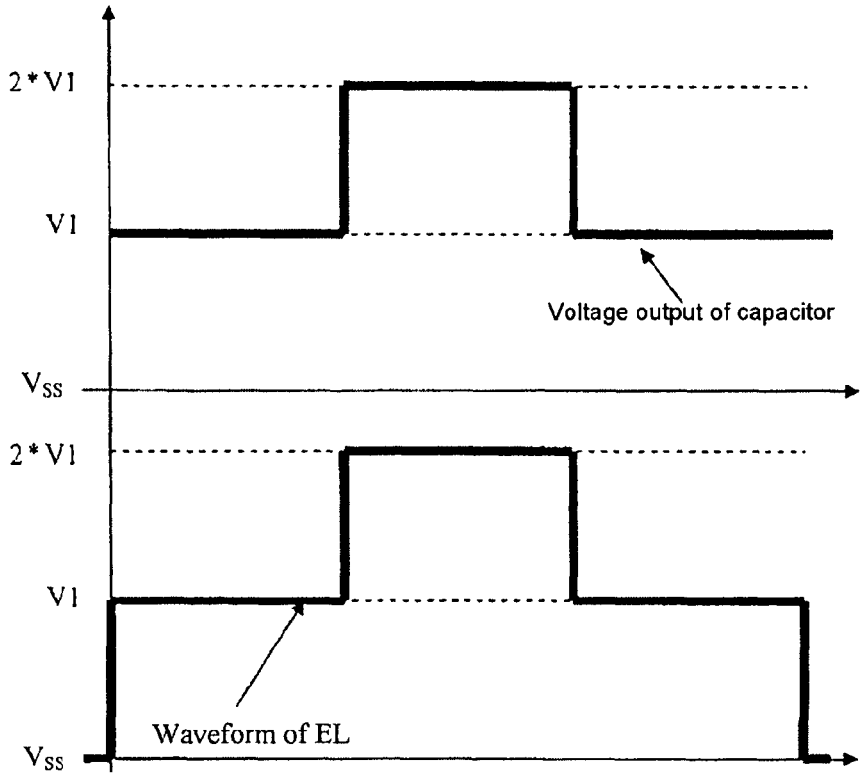
Figure 8A (Prior Art)
Figure 8B (Prior Art)

DUAL OUTPUT VOLTAGE SYSTEM WITH CHARGE RECYCLING

TECHNICAL FIELD

The present invention generally relates to a drive system for a flat panel display. More particularly, the present invention relates to a dual output voltage system with charge recycling in Electrophoretic Panel Display (EPD) applications.

BACKGROUND

Panel displays are commonly used in electronic products. It is known to provide panel displays based on electrophoretic effects. Electrophoretic effects comprise charged particles dispersed in a fluid or liquid medium moving under the influence of an electric field. As an example of the application of the electrophoretic effects, displays may use charged pigment particles dispersed and contained in a dye solution and arranged between a pair of electrodes. The dye solution in which charged pigment particles are dispersed is known as "electrophoretic ink" or "electronic ink." A display using electrophoretic ink is known as an electrophoretic display ("EPD"). Under the influence of an electric field, the charged pigment particles are attracted to one of two display electrodes. In response, the desired images are displayed.

In recent years, EPD technology was introduced for use in flat panel display. FIGS. 1A and B illustrate a technology using tiny microcapsules filled with electrically charged white particles suspended in a pigmented oil. For example, FIG. 1A illustrates one implementation in which the underlying circuitry controls whether white particles are at the top or bottom of the capsule. In this example, if the white particles are at the top of the capsule, the display appears white to the viewer. On the other hand, if the white particles are at the bottom of the capsule, the viewer sees the color of the oil, as illustrated in FIG. 1B. Therefore, the use of microcapsules allows the display to be used on flexible plastic sheets, as well as on glass.

One feature of EPD technology is that the pixels are bistable. That is, the pixels can be maintained in either of two states without a constant supply of power. Another feature of EPD technology is that particles in an EPD panel move in different directions according to control voltages, in order to display different colors. As a result, EPD panels have a response time which is slower than those of other types of flat panel display.

One application of EPD technology, the electronic paper display device, is being developed as a next generation display device to replace liquid crystal display devices, plasma display panels, and organic electro-luminescent display panels. In particular, electronic paper display panels using "electronic ink" are expected to be a replacement, in certain applications, for existing print media such as books, newspapers, magazines, or the like.

An electronic ink display is well suited for use in a flexible display device because the device can be created on a flexible substrate. For example, by creating an electronic ink display device in a panel using a substrate of a flexible material, the electronic ink display device may have the advantages of flexibility, simplicity, and reliability. The electronic ink display device may also provide the means to construct paper-thin reflective displays without use of a backlight, resulting in very low power consumption.

However, the drive system of EPD panels requires high voltage levels. These high voltages can be provided by traditional DC-DC methods. However, low power consumption is an important objective in applications including EPD technologies. As a result, it is desirable to reduce power consumption in these applications.

FIG. 2 illustrates typical drive voltage levels and a waveform for an electrophoretic panel display. Initially, a top transparent "segment" electrode is connected to a first voltage level (V1). The segment electrode is then driven to a second, higher, voltage level (V0) before being returned to V1. For the entire period, a common electrode is always connected to V1.

A second DC-DC method is disclosed by Kurt Muhlemann, in an article entitled "A 30-V Row/Column Driver for Flat-Panel Liquid Crystal Displays." Muhlemann presents the system architecture used in a STN (twisted-nematic) display driver, which can be slightly modified for use in an electrophoretic panel display (EPD). For example, FIG. 3 shows a high voltage generation circuit 300 with output voltages V0 and V1. The analog buffer 301 is supplied with voltages V0, of a positive value, and $V_{ss}$, of zero value. In general, voltage V0 may be generated from a regulated charge pump 302 or provided by an external power supply. A resistor ladder 303 is employed to set V1 as a reference voltage level.

The function of analog buffer 301 is to provide a large driving capability for the V1 voltage. Also shown in FIG. 3 is a simplified segment and common (Seg/Com) controller 304. Seg/Com controller 304 consists of a plurality of switches, coupled to a plurality of pixels (only one of which is shown) in the EPD panel. Each pixel may be represented by a capacitor $C_{PIXEL}$ 305. The plurality of switches in Seg/Com controller 304 may be used to connect the pixels of the panel to the different voltage levels, such as V0, V1, or $V_{ss}$.

However, the voltage generation method disclosed above presents several disadvantages. For example, analog buffer 301 consumes static current. Thus, analog buffer 301 and resistor ladder 303 exhibit current consumption which cannot be reduced even when the driving waveform (as shown in FIG. 2) is not active.

Yet another disadvantage of the above-described voltage generation method is that the electrical charges in the panel's pixel may not be recycled or reused. As mention above, each of the pixels can be represented by a capacitor ($C_{PIXEL}$) 305.

The structure of FIG. 2, can exhibit charge transfer as shown in FIGS. 4 and 5. FIG. 4 depicts Seg/Com controller 304 as separate elements (segment 406 and common 407). As shown in FIG. 4, during phase 1 of FIG. 2, a segment 406 is connected to a V0 source and charged from V1 to V0. During phase one, common 407 is also connected to V1. During this operation, segment 406 stores charge (Q) as determined by Equation 1.

$$Q=(V0-V1)*C_{Pixel} \quad \text{(Eq. 1)}$$

As shown in FIG. 5, during phase 2 of FIG. 2, the segment 406 is connected to a bias source of V1. At this time, a charge in the segment 406 equal to (V0-V1)*$C_{PIXEL}$ will be discharged. If bias voltage V1 is provided by an analog buffer 301, the charge in the panel's pixel will go to ground ($V_{ss}$) through analog buffer 301 and be dissipated. Thus, no charge from the pixel can be reused or recycled, thereby resulting in undesirably high current consumption.

This shortcoming has been addressed in U.S. Pat. No. 6,556,177 to Katayama et al. by a charge recycling system 600 for electroluminescent display panel (EL) applications (FIG. 6). The system disclosed by Katayama includes a power supply at V1 and a capacitor 602, which may represent a pixel ($C_{PIXEL}$). System 600 may also include a capacitor 601, to perform charge recycling. As a result, system 600 of Katayama provides a voltage level that is twice the value of V1.

FIGS. 7A-C show the charge recycling operation of Katayama. As shown in FIG. 7A, during phase 1, a pixel capacitor 602 and recycle capacitor 601 are charged from $V_{ss}$ to V1. During phase 2, switches operate as shown in FIG. 7B, such that the capacitor 601 is connected in series with the power supply (V1). The voltage across capacitor 601 then rises to a level equal to twice the value of V1 (2*V1) and charges the pixel 602 to the same level. During this operation, a charge equal to V1*$C_{PIXEL}$ is transferred to pixel capacitor 602. As shown in FIG. 7C, during phase 3, switches operate as shown, such that pixel capacitor 602 is connected to V1 again. The charge equal to V1*$C_{PIXEL}$ is transferred back and stored in the capacitor 601.

FIGS. 8A-B illustrate the voltage output of capacitor 601 and the waveform EL of pixel 602 as part of the charge recycling system 600 disclosed by Katayama. Initially, as shown in FIG. 8A, during phase 1, switches operate such that capacitor 601 is charged from $V_{ss}$ to V1. During phase 2, as shown in FIG. 8A, switches operate such that capacitor 601 is connected in series with the power supply (V1). Capacitor 601 then rises to a voltage level equal to twice the value of V1 (2*V1). During this operation, a charge equal to V1*$C_{PIXEL}$ is transferred to pixel capacitor 602. During phase 3, the charge equal to V1*$C_{PIXEL}$ is transferred back and stored in the capacitor 601.

As shown in FIG. 8B, during phase 1, pixel capacitor 602 (EL) is charged by a voltage V1. During phase 2, as shown in FIG. 8B, capacitor 601 has a voltage level equal to twice the value of V1 (2*V1) and charges pixel capacitor 602 to the same voltage level (2*V1). During this operation, a charge equal to V1*$C_{PIXEL}$ is transferred to pixel capacitor 602 (EL). As shown in FIG. 8B, during phase 3, the voltage across pixel 602 is once again V1. Accordingly, a charge equal to V1*$C_{PIXEL}$ is transferred from pixel 602 and stored in the capacitor 601.

However, since capacitor 601 disclosed by Katayama is charged to V1 during phase one and employed to generate a voltage level equal to twice the value of V1 (2*V1) at phase two, sources of voltages V1 and 2*V1 do not exist at the same time. FIG. 8 illustrates the waveform EL of pixel capacitor 602 during a charge recycling operation. FIG. 8A shows that the voltage waveform of pixel capacitor 602 is dependent on the operation of the capacitor 601.

FIGS. 8A-B also show the available voltages of this system at each phase. At phases one and three, voltage levels V1 and $V_{ss}$ are available for driving the pixels. At phase two, 2*V1 and $V_{ss}$ levels are available. Due to this voltage availability limitation, only one drive voltage level (either V1 or 2*V1) is available for driving the pixels at any one time.

The output voltages of the DC-DC converter in Katayama are not continuous in time. Using the typical drive waveform for EPD pixels given in FIG. 2 as an example, if V0 and V1 are not available simultaneously from the DC-DC converter in the form of continuous time voltages, a method for driving different pixels in sequence instead of in common will not be possible. Driving different pixels in sequence comprises starting and stopping a drive scheme of, for example V1-V0-V1, for different pixels at different times. Driving different pixels in common comprises starting and stopping the drive scheme for different pixels at the same time.

As such, there is a need for a power efficient charge recycling DC-DC converter system that provides continuous time output voltages.

SUMMARY

In one exemplary embodiment, there is provided a drive system for a flat panel display having segment and common lines. The system may include a first charge pump, including an input terminal for receiving electric charge at an input voltage level and a circuit for generating a first pumped voltage level. The system may also include a first storage capacitor coupled to the first charge pump for storing electric charge at the first pumped voltage level. The system may include a second charge pump, including an input terminal coupled to the first storage capacitor for receiving electric charge at the first pumped voltage level; a pump output terminal; and a circuit for generating a second pumped voltage level at the pump output terminal. The system may further include a second storage capacitor coupled to the pump output terminal for storing electric charge at the second pumped voltage level. The system may also include a controller coupled to the first and second storage capacitors, including segment and common output terminals respectively coupled to segment and common lines of an associated flat panel display; a plurality of switching devices coupled to the first and second storage capacitors; and a control circuit operating the switching devices to selectively connect the segment output terminal to the first and second storage capacitors so as to supply charge to the segment output terminal during a first phase and to return charge from the segment output terminal to the second storage capacitor during a second phase.

It is to be understood that both the foregoing general description and the following detailed description are exemplary and explanatory only and are not restrictive of the invention, as described. Further features and/or variations may be provided in addition to those set forth herein. For example, the present invention may be directed to various combinations and subcombinations of the disclosed features and/or combinations and subcombinations of several further features disclosed below in the detailed description.

BRIEF DESCRIPTION OF THE DRAWINGS

The accompanying drawings, which are incorporated in and constitute a part of this specification, show certain aspects of the present invention and, together with the description, help explain some of the principles associated with the invention. In the drawings, FIG. 1A and B illustrate a cross-section of a thin electrophoretic film in accordance with the prior art;

FIG. 7A-C illustrate an exemplary process of charging a pixel ($C_{PIXEL}$) in three different stages according to the prior art;

FIG. 8A-B illustrate an exemplary waveform showing the process of charging a pixel ($C_{PIXEL}$) in three different stages according to the prior art.

DETAILED DESCRIPTION

Reference will now be made in detail to the invention, examples of which are illustrated in the accompanying drawings. The implementations set forth in the following description do not represent all implementations consistent with the claimed invention. Instead, they are merely some examples consistent with certain aspects related to the invention. Wherever possible, the same reference numbers will be used throughout the drawings to refer to the same or like parts.

Figure 9:
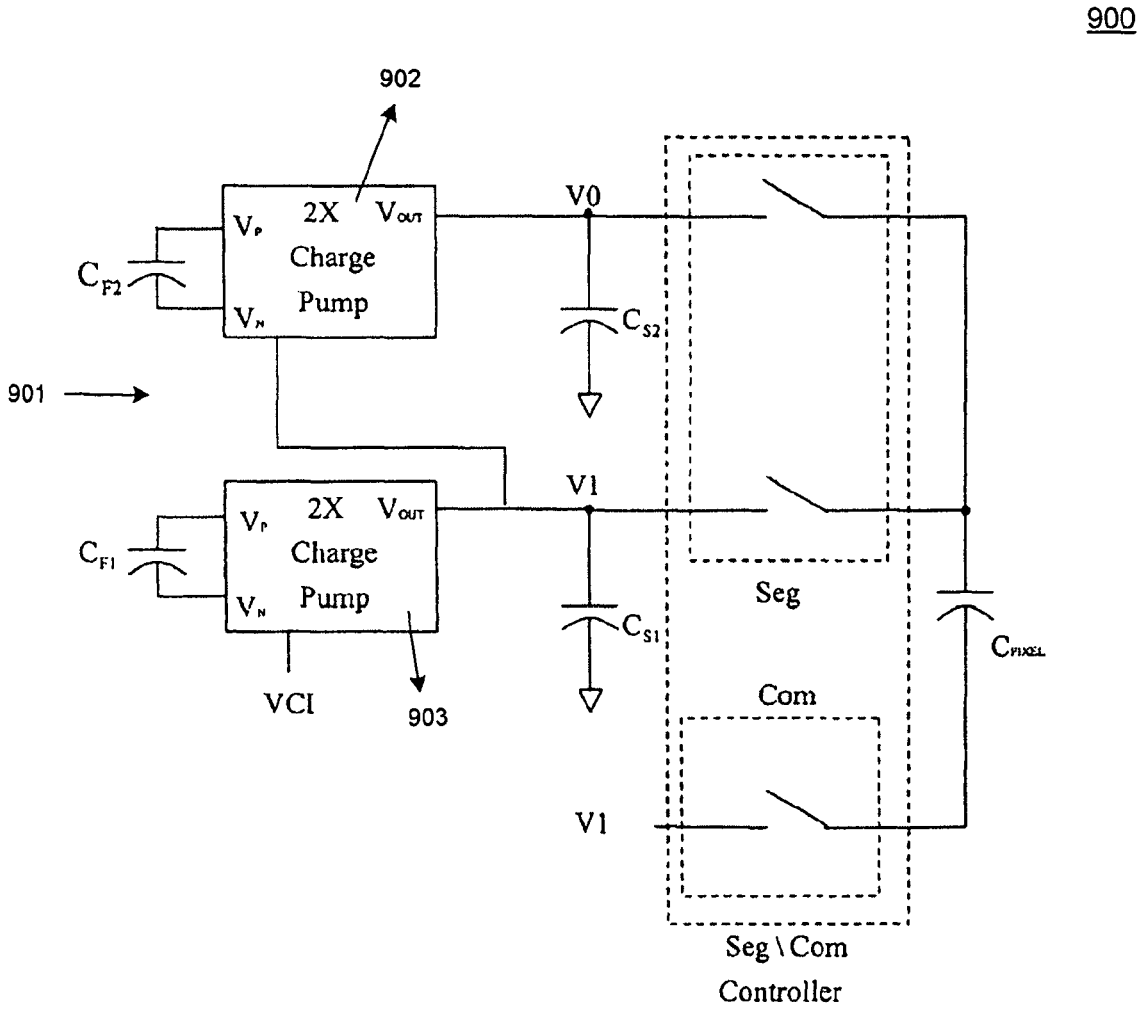
FIG. 9 illustrates a dual output voltage system consistent with the present invention.

FIG. 9 shows a drive system 900 for an electrophoretic panel display (EPD) consistent with the present invention. System 900 constitutes a dual output voltage system and includes a 4× booster circuit 901 that consists of two 2× booster circuits 902 and 903. A first stage charge pump 903 provides voltage level V1. Voltage level V1 may be employed to drive an electrophoretic panel display (EPD) without the use of a traditional analog buffer. In addition, the output of first stage charge pump 903 is supplied to the input of a second stage charge pump 902, which generates a V0 voltage level. All voltage levels in FIG. 9 are referenced to a common voltage $V_{ss}$.

In general, the drive capacity of charge pump 903 is greater than that of an analog buffer. Eliminating the use of a traditional analog buffer may also result in lower power consumption and a smaller silicon area. The design of system 900 may also eliminate driving capability limitations posed by analog buffers.

In contrast to the analog buffers employed by prior art systems, in system 900, the response time for driving an electrophoretic panel display (EPD) with the output of charge pump 903 only depends on the storage capacitance and the segment resistance. It should be noted that the proposed design of system 900 may provide either dual regulated voltages or one regulated output voltage, depending on the required accuracy of the output voltages.

In FIG. 9, each 2× charge pump 902 and 903 consists of switches employed to transfer energy and boost the input voltage to output voltage (not shown); a flying capacitor $C_{F1}$ or $C_{F2}$ employed to transfer charge; a comparator and feedback network, employed to control and define a regulated output level (not shown); and a storage capacitor $C_{S1}$ or $C_{S2}$, employed to store energy charge and to stabilize the output voltage level.

Figure 10:
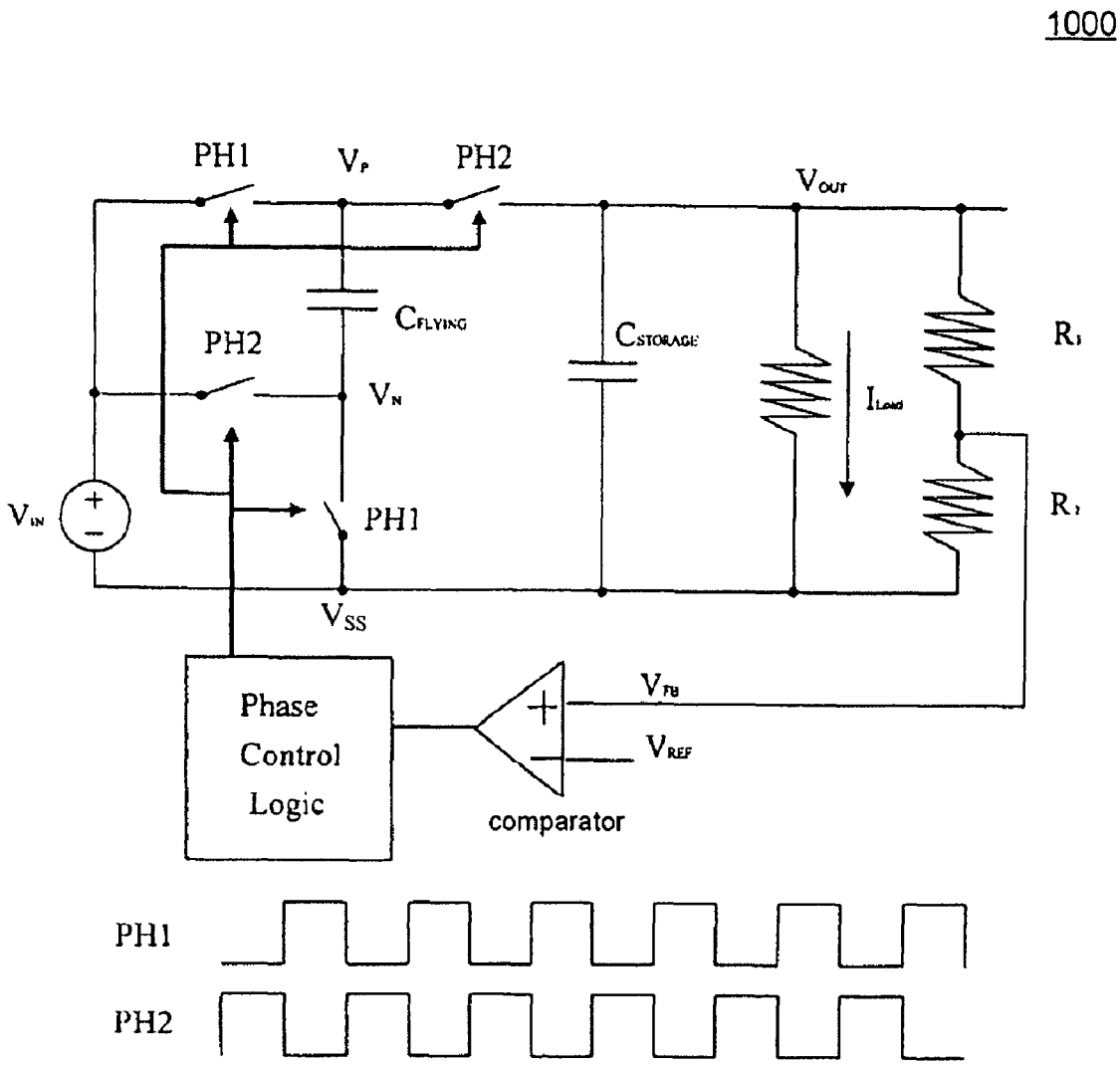
FIG. 10 illustrates a typical 2× charge pump with regulated output function consistent with the present invention.

FIG. 10 illustrates a 2× charge pump 1000 with regulated output function that may be implemented as charge pump 902 or 903. The operation principle of 2× charge pump 1000, including two phases, is now described.

In phase one, clock driver PH1 switches are operated by Phase Control Logic such that a flying capacitor, $C_{flying}$, is pre-charged to Vin level with a VN terminal connected to $V_{ss}$ and a VP terminal connected to Vin.

In phase two, PH1 switches are opened while PH2 switches are closed. Terminal VN is connected to Vin level and terminal VP is pumped to a 2× $V_{IN}$ voltage level by a capacitor coupling effect. The charge stored in $C_{flying}$ will perform the charge redistribution, with $C_{storage}$ providing charge at a 2× $V_{IN}$ voltage level to $V_{out}$.

The regulated mode of the 2× charge pumps is now described. In 2× charge pump 1000, resistors R1 and R2 function as a voltage divider. This voltage divider defines the regulated output value. A feedback voltage $V_{FB}$ is compared with a pre-defined reference voltage $V_{REF}$ by the voltage comparator. If $V_{FB}$ is larger than $V_{REF}$, the voltage comparator will output a control signal to the phase control logic, directed to stop the pump action by stopping the clock driving the switches, e.g., switches PH1, PH2.

Figure 1A:
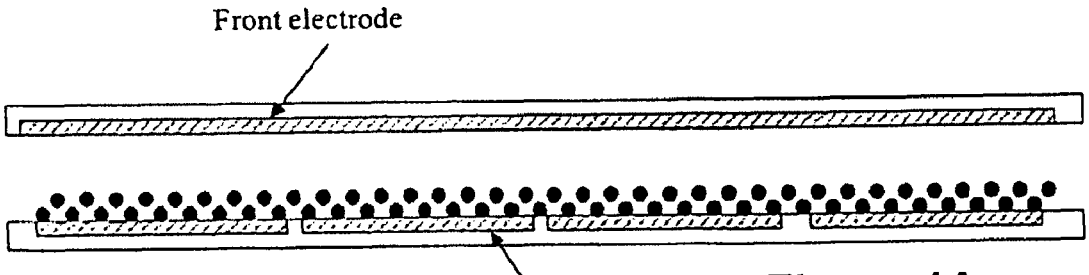
Figure 1A (Prior Art)
Figure 1B:
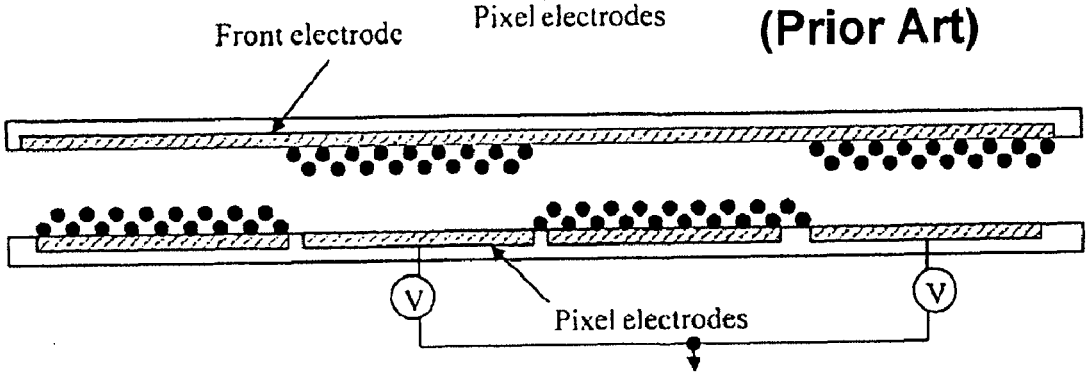
Figure 1B (Prior Art)
Figure 2:
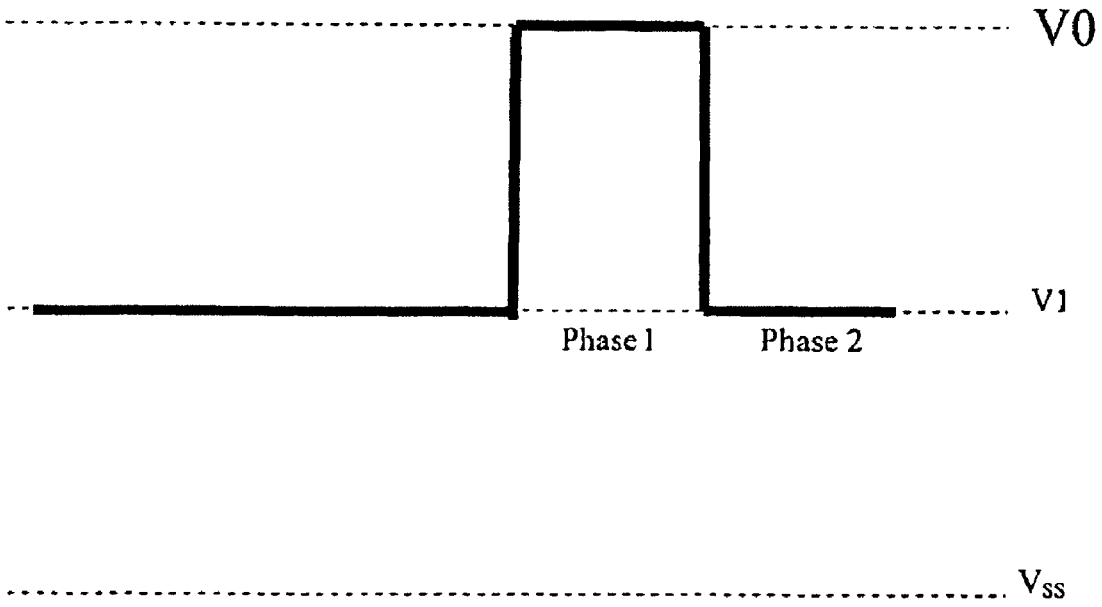
Figure 2 (Prior Art)
FIG. 2 illustrates a typical drive voltage waveform and voltage level according to the prior art.
Figure 3:
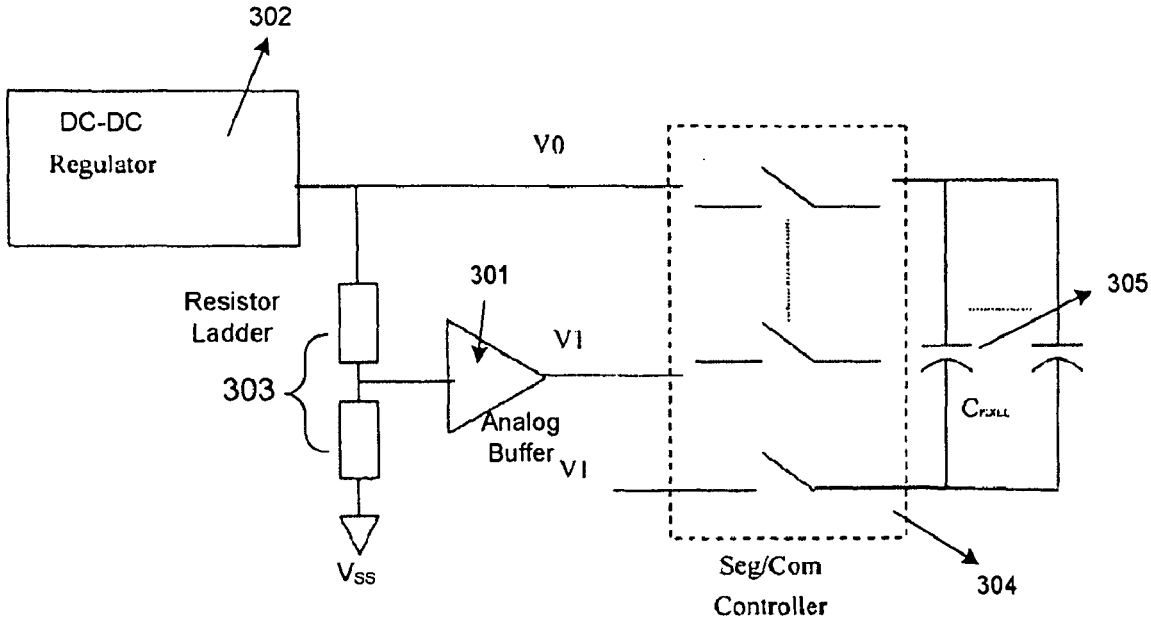
Figure 3 (Prior Art)
FIG. 3 illustrates a typical voltage generation circuit according to the prior art.
Figure 4:
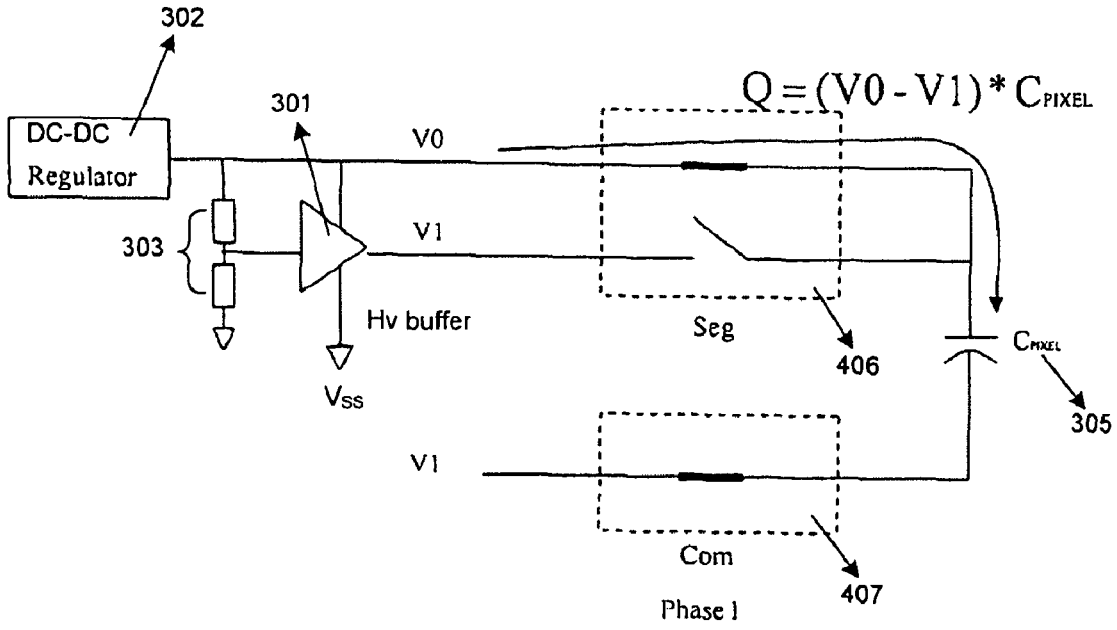
Figure 4 (Prior Art)
FIG. 4 illustrates an exemplary process of charging a pixel ($C_{PIXEL}$) from $V_{ss}$ to V0 according to the prior art.
Figure 5:
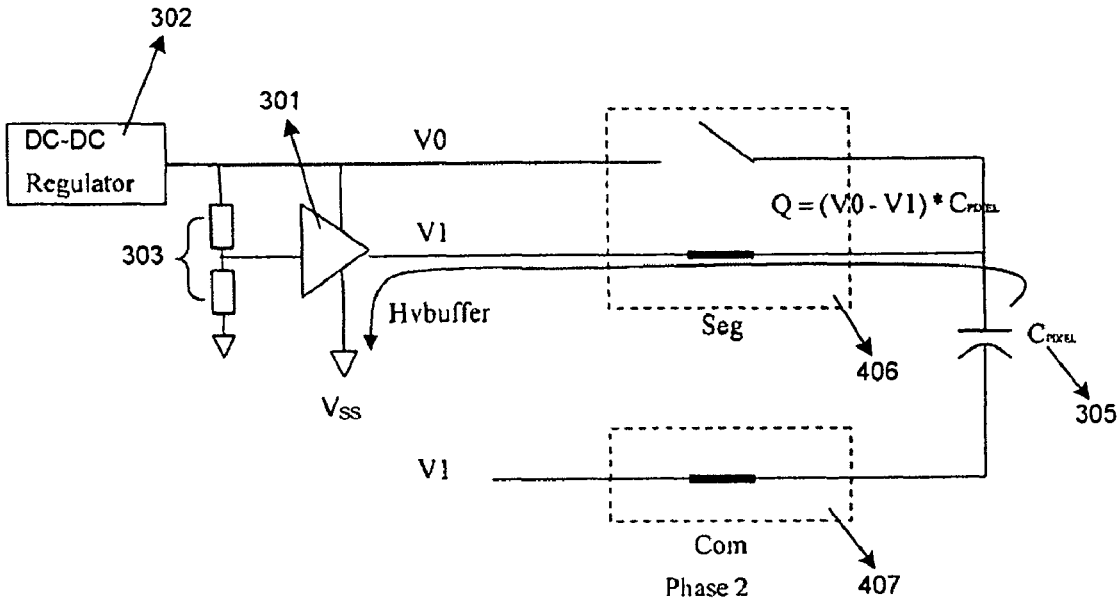
Figure 5 (Prior Art)
FIG. 5 illustrates an exemplary process of discharging a pixel ($C_{PIXEL}$) from V0 to V1 according to the prior art.
Figure 6:
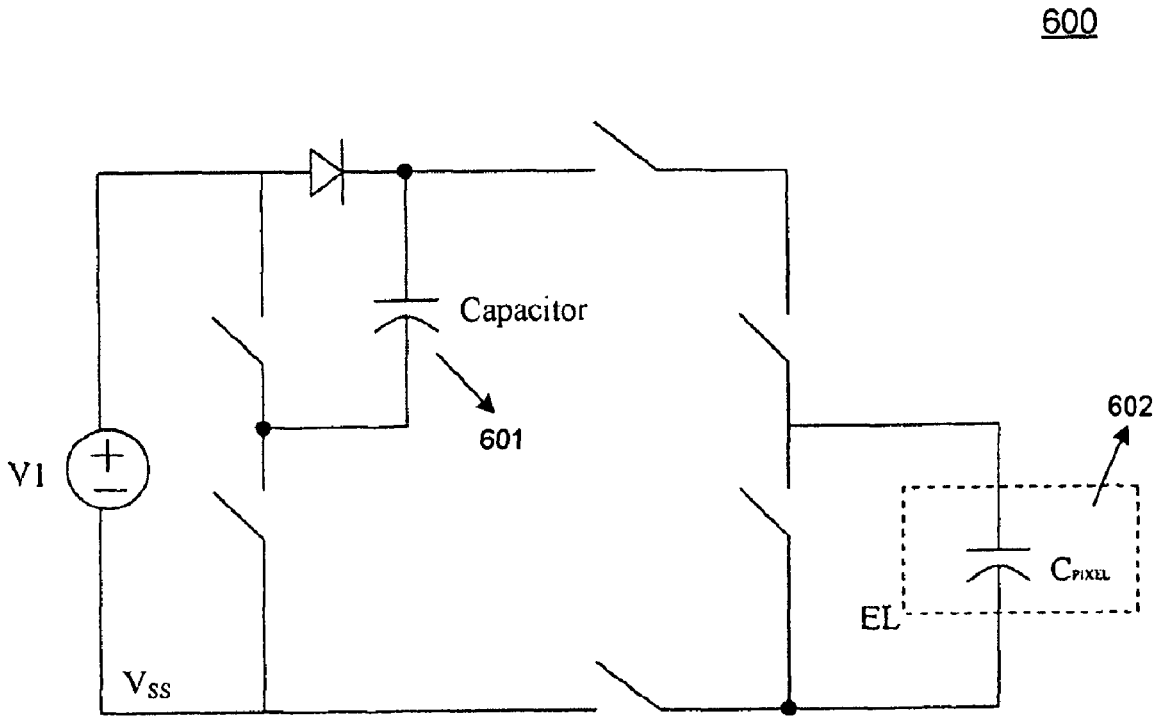
Figure 6 (Prior Art)
FIG. 6 illustrates an exemplary charge recycling circuit according to the prior art.
Figure 7A:
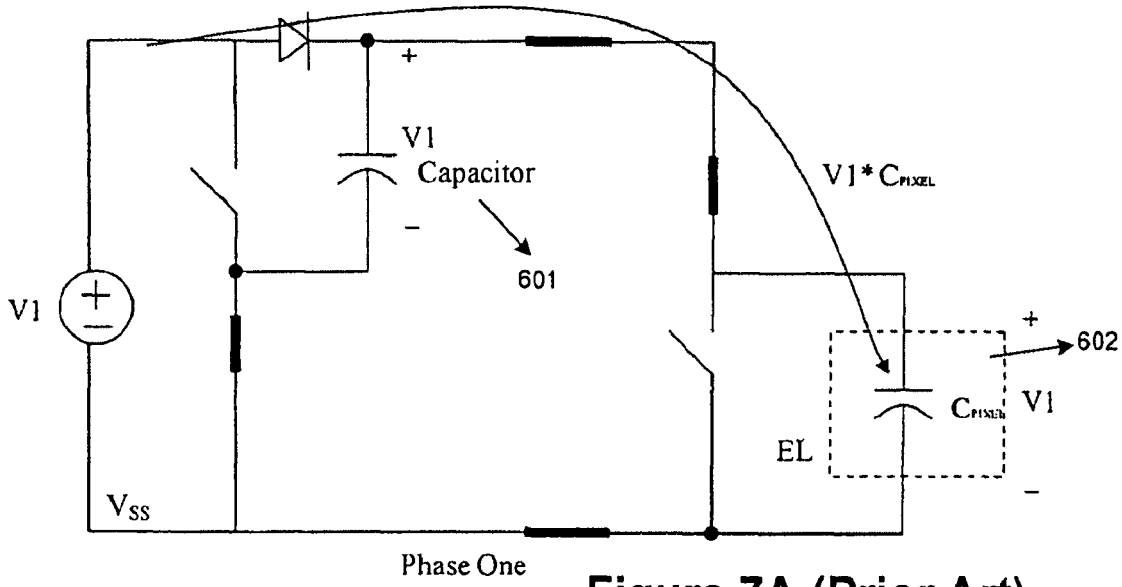
Figure 7A (Prior Art)
Figure 7B:
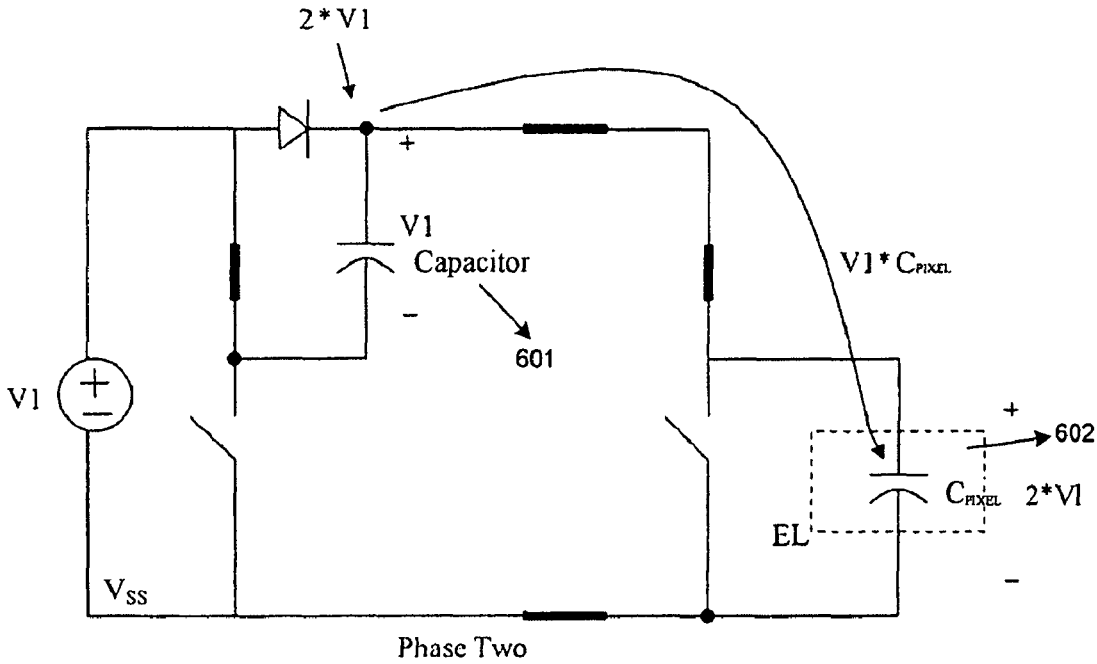
Figure 7B (Prior Art)
Figure 11:
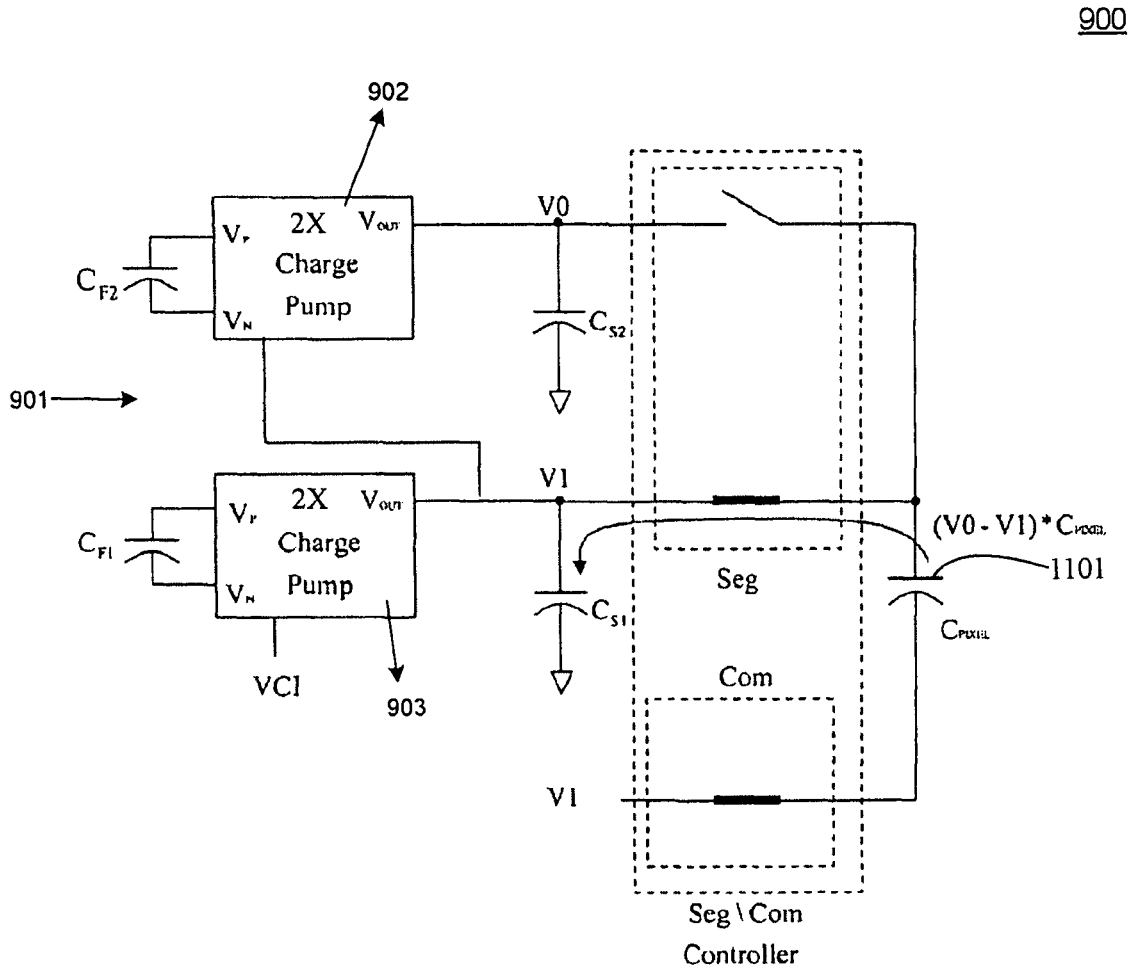
FIGS. 11 and 12 illustrate the operation of the proposed dual voltage output system with a pixel consistent with the present invention.
Figure 12:
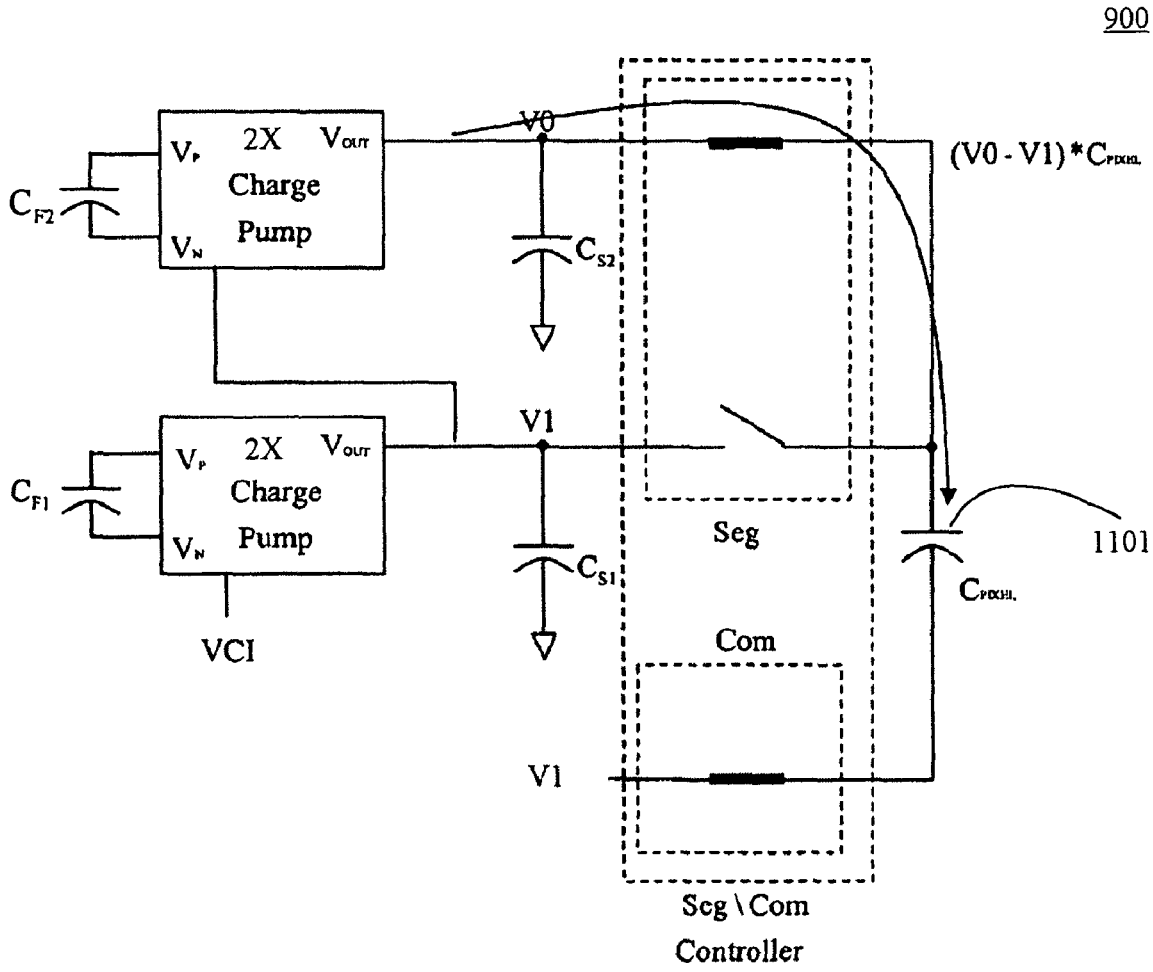

FIGS. 11 and 12 illustrate the operation of system 900 with a pixel, represented by capacitor 1101, with the waveform at FIG. 2. The operation is separated into phase one and phase two. During phase one (FIG. 12), pixel capacitor 1101 is charged to V0 from V1. As a result, an amount of charge equal to (V0-V1)*$C_{PIXEL}$ is transferred to the pixel capacitor 1101. During phase two (FIG. 11), pixel capacitor 1101 is connected to V1. The charge equal to (V0-V1)*$C_{PIXEL}$ is then released and transferred back to $C_{S1}$. These charges not only increase the voltage level of V1, but may also function as an energy source for the second stage charge pump 902. Therefore, by returning the charges, they may be reused rather than discharged to $V_{ss}$.

As a result, in system 900, voltages V0, V1, and $V_{ss}$ exist at the same time. Also, output voltages are continuously maintained by means of the capacitors ($C_{S1}$, $C_{S2}$). The pixel's waveform does not depend on the switching frequency and timing of the charge pump or power system. Moreover, a new pixel's waveform does not need to wait for the previous pixel's waveform to be completed first.

Although system 900 shows architecture with two similar charge pump stages, each charge pump stage outputting a voltage level 2× of input voltage level, the architecture of system 900 may be extended to allow cascading of stages which may not be similar in circuit configurations and which may have different times of multiplication of input voltages (e.g., 3×, 4×, etc.). The architecture of system 900 can also extend, for example, to a charge pump system consisting of multiple branches of cascaded stages, with downstream stages taking electronic charges from the outputs of upstream stages of multiple branches, in order to produce outputs at voltage levels required in the application, wherein optimization of power efficiency considerations on the system level will indicate the optimal output to be used for the input of each stage.

Various configurations are possible. For example, all components of system 900 may be packaged as an integrated circuit.

System level consideration for power efficiency should take the driving scheme and the panel loading into account. Generally, the overall charge pump system would consist of a minimum number of stages that can still meet the number of drive levels required. The system should balance charging and discharging of panel loading in order to minimize instantaneous power demand from power supplies.

The foregoing description is intended to illustrate but not to limit the scope of the invention, which is defined by the scope of the appended claims. Other embodiments are within the scope of the following claims.

What is claimed is:

1. A drive system for a flat panel display having segment and common lines, the system comprising:

a first charge pump comprising:

an input terminal for receiving electric charge at an input voltage level;

a first pump output terminal; and a circuit for generating a first pumped voltage level at the first pump output terminal;

a first storage capacitor coupled to the first charge pump for storing electric charge at the first pumped voltage level;

a second charge pump comprising:

an input terminal coupled to the first pump output terminal and to the first storage capacitor for receiving electric charge at the first pumped voltage level;

a second pump output terminal; and a circuit for generating a second pumped voltage level at the second pump output terminal;

a second storage capacitor coupled to the second pump output terminal for storing electric charge at the second pumped voltage level; and a controller coupled to the first and second storage capacitors and comprising:

segment and common output terminals respectively coupled to segment and common lines of an associated flat panel display;

a plurality of switching devices coupled to the first and second storage capacitors; and a control circuit operating the switching devices to selectively connect the segment output terminal to the first and second storage capacitors so as to supply charge to the segment output terminal during a first phase and to return charge from the segment output terminal to the first storage capacitor during a second phase.

2. The system of claim 1 wherein at least one of the first and second charge pumps employ at least one resistor ladder and comparator, in feedback regulation, to control the voltage level at predetermined values.

3. The system of claim 1, wherein at least a portion of the system is packaged as an integrated circuit (IC) configured to provide a driving scheme for the associated display.

4. The system of claim 1, wherein the first and second charge pumps comprise switches operate to transfer energy and boost the input voltage to output voltage.

5. The system of claim 1, wherein the first and second charge pumps comprise a flying capacitor configured to transfer charge.

6. The system of claim 1, further comprising a plurality of additional charge pumps configured to acquire electric charge from storage capacitors in upstream pumps for pumping charge to generate subsequent voltage levels, said additional pumps having corresponding storage capacitors for holding electric charge at subsequent corresponding voltage levels wherein return of electronic charge to at least one of the upstream storage capacitors from the coupled segment and common lines of an associated flat panel is facilitated by the controller during a phase of a multi-phase multi-level driving scheme.

7. The system of claim 6, wherein the plurality of downstream charge pumps comprise switches employed to transfer energy and boost the input voltage to output voltage.

8. The system of claim 6, wherein the plurality of downstream charge pumps comprise a flying capacitor configured to transfer charge.

* * * * *